US006256025B1

(12) United States Patent
Imai et al.

(10) Patent No.: US 6,256,025 B1
(45) **Date of Patent: *Jul. 3, 2001**

(54) DRIVING VOLTAGE GENERATING CIRCUIT FOR MATRIX-TYPE DISPLAY DEVICE

(75) Inventors: Masahiro Imai, Yamatokoriyama; Kunihiko Yamamoto, Kashiba, both of (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/022,412

(22) Filed: Feb. 12, 1998

(30) Foreign Application Priority Data

Feb. 26, 1997 (JP) ..... 9-042677
Jan. 30, 1998 (JP) ..... 10-019979

(51) Int. Cl.[7] ..... G09G 5/00

(52) U.S. Cl. ..... 345/211; 345/212; 345/213; 345/210

(58) Field of Search ..... 345/211–213, 52, 345/61, 69, 80, 94, 95, 98, 208, 210

(56) References Cited

U.S. PATENT DOCUMENTS

| | | | | |
|---|---|---|---|---|
| 5,070,255 | * | 12/1991 | Shin | 327/408 |
| 5,198,747 | * | 3/1993 | Haight | 323/303 |
| 5,298,913 | | 3/1994 | Numao et al. . | |
| 5,455,534 | * | 10/1995 | Motegi et al. | 327/544 |
| 5,675,352 | * | 10/1997 | Rich et al. | 345/89 |
| 5,801,671 | * | 9/1998 | Kobayashi et al. | 345/95 |
| 5,854,627 | * | 12/1998 | Kurihara et al. | 345/211 |
| 5,859,632 | * | 1/1999 | Ito | 345/211 |
| 5,861,863 | * | 1/1999 | Kudo et al. | 345/100 |
| 5,982,349 | * | 11/1999 | Yoon | 345/98 |

FOREIGN PATENT DOCUMENTS

| | | |
|---|---|---|
| 6019428 | 1/1994 | (JP) . |
| 7056538 | 3/1995 | (JP) . |
| 8146382 | 6/1996 | (JP) . |
| 9050003 | 2/1997 | (JP) . |

OTHER PUBLICATIONS

S. Matsumoto et al., "Most Up–to–Date Technology on Liquid Crystal", 1983, pp. 106–107.
T.N. Ruckmongathan, "A Generalized Addressing Technique for RMS Responding Matrix LCDS", 1988 International Display Research Conference, pp. 80–85.
T.J. Scheffer, "Active Addressing Method for High–Contrast Video–Rate STN Displays", SID 92 Digest, pp. 228–231.
S. Ihara et al., "A Color STN–LCD With Improved Contrast, Uniformity, and Response Times", SID 92 Digest, pp. 232–235.

* cited by examiner

*Primary Examiner*—Richard A. Hjerpe
*Assistant Examiner*—Henry N. Tran

(57) ABSTRACT

A driving voltage generating circuit of a matrix-type display device includes a voltage dividing resistor group composed of a plurality of voltage dividing resistors connected in series, for dividing a potential a difference of a reference voltage. It also includes operational amplifiers for generating and outputting row voltages (a selective voltage and a non-selective voltage) to be applied to row electrodes, by subjecting each voltage obtained by voltage division to impedance conversion. A p-channel MOSFET and an n-channel MOSFET as analog switches for altering a level of each voltage thus generated are provided in parallel with voltage dividing resistors at ends of the voltage dividing resistor group. With this arrangement, the number of elements necessary for the circuit, for example, MOSFETS and level shifters for controlling the MOSFETS, can be decreased. Therefore, the size of the driving voltage generating circuit can be reduced. As such, price lowering and reduction of power consumption can be achieved.

4 Claims, 11 Drawing Sheets

DRIVING VOLTAGE GENERATING CIRCUIT FOR MATRIX-TYPE DISPLAY DEVICE

FIELD OF THE INVENTION

The present invention relates to a driving voltage generating circuit for generating voltages for driving a display section of a matrix-type display device which is widely applied to audio-visual equipments, office automation equipments, game machines, and the like.

BACKGROUND OF THE INVENTION

A matrix-type display device has a display section, a voltage generating circuit, a row electrode driving circuit, and a column electrode driving circuit. The display section has row electrodes and column electrodes which are arranged in a matrix form, and display is executed at points (pixels) at which the row electrodes and the column electrodes intersect each other. The voltage generating circuit is a circuit generating a row voltage for driving the row electrodes and a column voltage for driving the column electrodes. The row electrode driving circuit is a circuit for applying the row voltage outputted by the voltage generating circuit to the row electrodes. The column electrode driving circuit is a circuit for applying the column voltage outputted by the voltage generating circuit to the column electrodes.

Typical of such a matrix-type display device is a matrix-type liquid crystal display device. In the matrix-type liquid crystal display device, the display section is a liquid crystal panel composed of two electrode substrates having electrodes, between which liquid crystal material is sealed. Display is conducted by utilizing optical properties of the liquid crystal which change in response to application of the row voltage and the column voltage to the liquid crystal panel.

Such matrix-type liquid crystal display devices are roughly classified into two groups, (1) active matrix-type devices in which every pixel has an active element for controlling the driving voltage, and (2) simple matrix-type devices which are not equipped with active elements. The active matrix-type devices are incapable of display on large screens with high precision due to their complex structures. Further, their manufacturing costs are high. On the other hand, the simple matrix-type devices are capable of display on large screens and their manufacturing costs are relatively low, since their structures are simple.

As to a driving method for the simple matrix-type display devices, there are, for example, driving methods disclosed by (1) the Japanese Publication of Laid-Open Patent Application No. 6-19428/1994 (Tokukaihei 6-19428) and (2) the Japanese Publication of Laid-Open Patent Application No. 7-56538/1995 (Tokukaihei 7-56538).

The driving method disclosed by the publication (1) is characterized in that fluctuation of the row voltage is corrected by superimposing onto the row voltage a voltage in accordance with an effective application voltage, so as to suppress crosstalks which is recognized as a display irregularity. On the other hand, the driving method disclosed by the publication (2) is characterized in taking an amplitude modulation method in order to carry out gradation display.

Voltage generating circuits as disclosed by the publications (1) and (2) are arranged, for example, as shown in FIG. 11. The arrangement shown in FIG. 11 is an arrangement of a row voltage generating circuit in the case where a row voltage amplitude modulation method is applied.

In the row voltage generating circuit, a potential difference between reference potentials $V_{EE}$ and $V_{SS}$ is divided by a plurality of voltage dividing resistors $R_{101}$ through $R_{106}$, so that voltages at a plurality of levels are obtained. These voltages are subjected to impedance conversion by operational amplifiers 101 through 105, and are switched by analog switches. Here, the analog switches are composed of p-channel MOSFETs 111 and 113, and n-channel MOSFETs 112 and 114, respectively, where MOSFET stands for metal oxide semiconductor-type field effect transistor.

Control signals which have been subjected to level conversion by level shifters 121 and 122 are supplied to gates of the p-channel MOSFET 111 and the n-channel MOSFET 112, respectively. On the other hand, control signals (reversed by an inverter 131) which have been subjected to level conversion by level shifters 123 and 124 are supplied to gates of the p-channel MOSFET 113 and the n-channel MOSFET 114, respectively. Therefore, voltages supplied to the row electrode driving circuit (not shown) are switched in accordance with a logic level of the control signal, between a group of output voltages from the operational amplifiers 101, 103, and 105, and a group of output voltages from the operational amplifiers 102, 103, and 104.

Here, power source voltages $V_{101}$ through $V_{110}$ are supplied to the operational amplifiers 101 through 105. The analog switches are composed of the MOSFET 111 through 114, respectively, but they may be composed of bipolar transistors instead.

Incidentally, in the simple matrix-type liquid crystal display device as described above, the row electrodes and the column electrodes are usually driven by the amplitude selective addressing scheme, the plural-row simultaneous selection driving scheme, or the like. The amplitude selective addressing scheme is disclosed by, for example, "Ekisho no Saishin Gijutsu (Most Up-to-date Technology of Liquid Crystal)", p.106, published by Kogyo Chosa-kai Shuppan (Industry Research Institute Publishing Association). The plural-row simultaneous selection driving scheme is disclosed by, for example, T. N. Ruckmongathan, Conf. Record of 1988 International Display Research Conference, p.80 (1988), T. J. Scheffer and B. Clifton, 1992 SID Digest of Technical Papers XXIII, p.228 (1992), and S. Ihara et al., 1992 SID Digest of Technical Papers XXIII, p.232 (1992).

The amplitude selective addressing scheme and the plural-row simultaneous selection driving scheme are driving schemes based on the following basic principle: the row voltage waveform is expressed by an orthogonal matrix such as a unit matrix or a Walsh matrix, while the column voltage waveform is determined by orthogonal conversion of display information by the orthogonal matrix, and on the display panel, display is carried out by reverse conversion of the column voltage waveform into display information.

According to the basic principle, irrelevant to the display information, a constant effective voltage is applied to each pixel of non-selected rows, whose matrix elements of an orthogonal matrix correspond to 0. On the other hand, effective voltages in accordance with the display information are applied to pixels of the rows other than the non-selected rows.

According to the above-described basic principle, if the number of plural rows simultaneously selected is N (N=1 in the case of the amplitude selective addressing scheme), voltages at three levels, that is, positive and negative selective voltages and a non-selective voltage, are necessary as row voltages, while voltages at (N+1) levels are necessary as column voltages. Besides, in the case where either of the driving methods disclosed by the publications (1) and (2) is applied, the necessary voltage levels increase, since additional potentials for suppression of crosstalk, gradation display, and the like are necessary.

Such an increase in the number of the voltage levels causes the circuitry scale to expand, thereby bringing about a rise of prices of liquid crystal display devices, and an increase in power consumption. For example, in the aforementioned voltage generating circuit, more operational amplifiers for the impedance conversion are necessary in addition to the operational amplifiers 101 through 105, so as to correspond to all voltage levels necessary for voltage switching, and the number of the analog switches also has to be increased to substantially the same number.

SUMMARY OF THE INVENTION

The present invention has been made in light of the above problems, and the object of the present invention is to provide a low-priced voltage generating circuit capable of switching and outputting voltages at plural levels, with small-scale circuitry, with low power consumption.

To achieve the above object, the driving voltage generating circuit of the present invention for use in a matrix-type display device is provided in a matrix-type display device. The matrix-type display device having the driving voltage generating circuit of the present invention incorporates an electrode driving unit for driving row electrodes and column electrodes by applying predetermined voltages thereto, respectively, the row and column electrodes being provided in a matrix form so as to carry out display with use of pixels, each of which is formed at a crossing point of the row and column electrodes. The driving voltage generating circuit of is the matrix-type display device comprises a voltage generating unit for generating voltages at a plurality of levels, which includes (1) a plurality of voltage dividing resistors for dividing a predetermined reference voltage so as to obtain a plurality of voltages and (2) a connecting member for changing the connection states of the voltage dividing resistors. The voltages at a plurality of levels are to be used for driving the row electrodes and the column electrodes. With the use of the connecting member, the connection states of the voltage dividing resistors are changed, so that voltages generated can be altered.

With this arrangement, voltages of different levels are outputted from the same point of a circuit composed of a plurality of voltage dividing resistors. Therefore, the number of circuits provided behind the voltage dividing resistors such as operational amplifiers for impedance conversion may be decreased, as compared with a driving voltage generating circuit arranged so that voltages resulting on voltage division by a plurality of voltage dividing resistors are switched. In other words, the number of the operational amplifiers can be smaller than the number of voltages necessary for the electrode driving unit. As a result, reduction of the size of the driving voltage generating circuit, and reduction of the price, and lowering of power consumption can be achieved.

For a fuller understanding of the nature and advantages of the invention, reference should be made to the ensuing detailed description taken in conjunction with the accompanying drawings.

DESCRIPTION OF THE PREFERRED EMBODIMENTS

First Embodiment

The following description will explain a first embodiment of the present invention.

Figure 3:
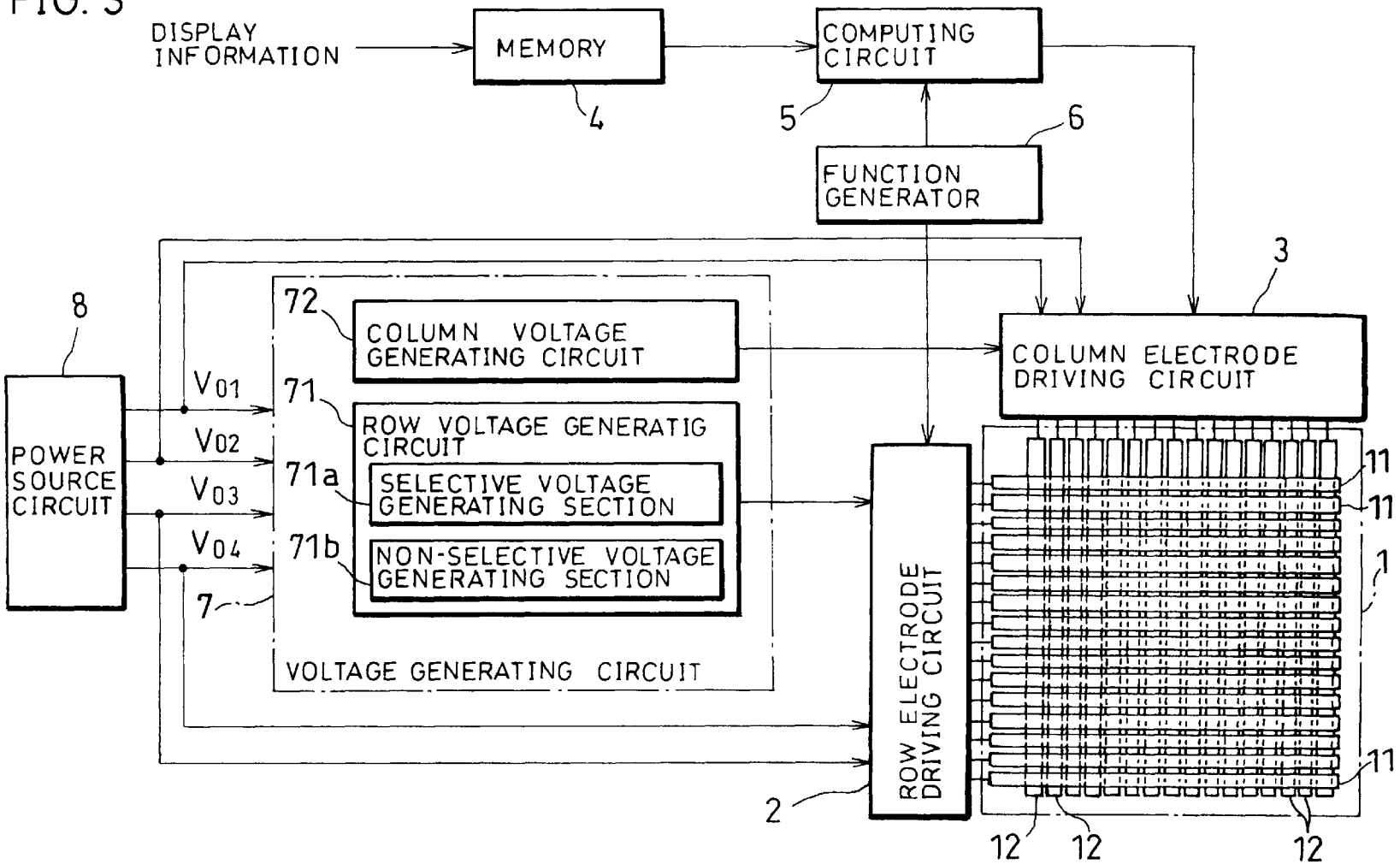
FIG. 3 is a block diagram illustrating an arrangement of the matrix-type liquid crystal display device.

As illustrated in FIG. 3, a simple matrix-type liquid crystal display (LCD) device in accordance with the present embodiment is provided with a liquid crystal panel 1, a row electrode driving circuit 2, a column electrode driving circuit 3, a memory 4, a computing circuit 5, a function generator 6, a voltage generating circuit 7, and a power source circuit 8. The LCD device is arranged so as to carry out multi-gradation display by the row voltage amplitude modulation method.

The liquid crystal panel 1 is equipped with a plurality of row electrodes 11 which are provided in parallel with each other in the row direction, and a plurality of column electrodes 12 which are provided in parallel with each other in the column direction. The row electrodes 11 and the column electrodes 12 are provided so as to orthogonally cross each other, with a liquid crystal layer (not shown) therebetween. At each crossing point of the row electrodes 11 and the column electrodes 12, a pixel is formed. The row electrodes 11 are connected to the row electrode driving circuit 2, while the column electrodes 12 are connected to the column electrode driving circuit 3.

Memory 4 is a memory device which temporarily stores display information inputted thereto, and is made of, for example, a frame memory. The computing circuit 5 is intended to carry out orthogonal conversion with respect to the display information supplied from the memory 4, with the use of an orthogonal function generated by the function generator 6. The function generator 6 is intended to generate and output an orthogonal function expressed by a unit matrix, a Walsh matrix, or the like.

The voltage generating circuit 7 has a row voltage generating circuit 71 and a column voltage generating circuit 72. The row voltage generating circuit 71 is composed of a selective voltage generating section 71*a* and a non-selective voltage generating section 71*b*. The selective voltage generating section 71*a* as selective voltage generating means is arranged so as to generate two selective voltages which are set to predetermined levels, so that desired row electrodes 11 are selected for display. The non-selective voltage generating section 71*b* is arranged so as to generate one nonselective voltage which is set to a predetermined level different from the levels of the selective voltages, so that the non-selective voltage is applied to row electrodes 11 which are not to be selected for display. The column voltage generating circuit 72 as column voltage generating means is aimed to generate a plurality of column voltages at predetermined levels, which are allotted to display information, respectively.

The row electrode driving circuit 2 as electrode driving means is aimed to apply selective voltages and non-selective voltages as row voltages outputted by the row voltage generating circuit 71, to the row electrodes 11, in accordance with an orthogonal function generated by the function generator 6. The column electrode driving circuit 3 as electrode driving means is aimed to select a column voltage outputted by the column voltage generating circuit 72, in accordance with the computation output of the computing circuit 5, and apply the selected voltage to a column electrode 12. The voltage applied to a pixel for display is a potential difference between the row voltage and the column voltage. Therefore, a value of the column voltage is determined in accordance with the value of the selective voltage as the row voltage and the display information.

Note that in a simple matrix-type LCD device wherein a display section 1 driven by the amplitude selective addressing scheme or the like, the memory 4 is omitted.

Subsequently, the voltage generating circuit 7 will go be explained. Here described is a case where a two-stage row voltage amplitude modulation method causing a ratio of row voltage levels in two periods to be constant.

Figure 2:
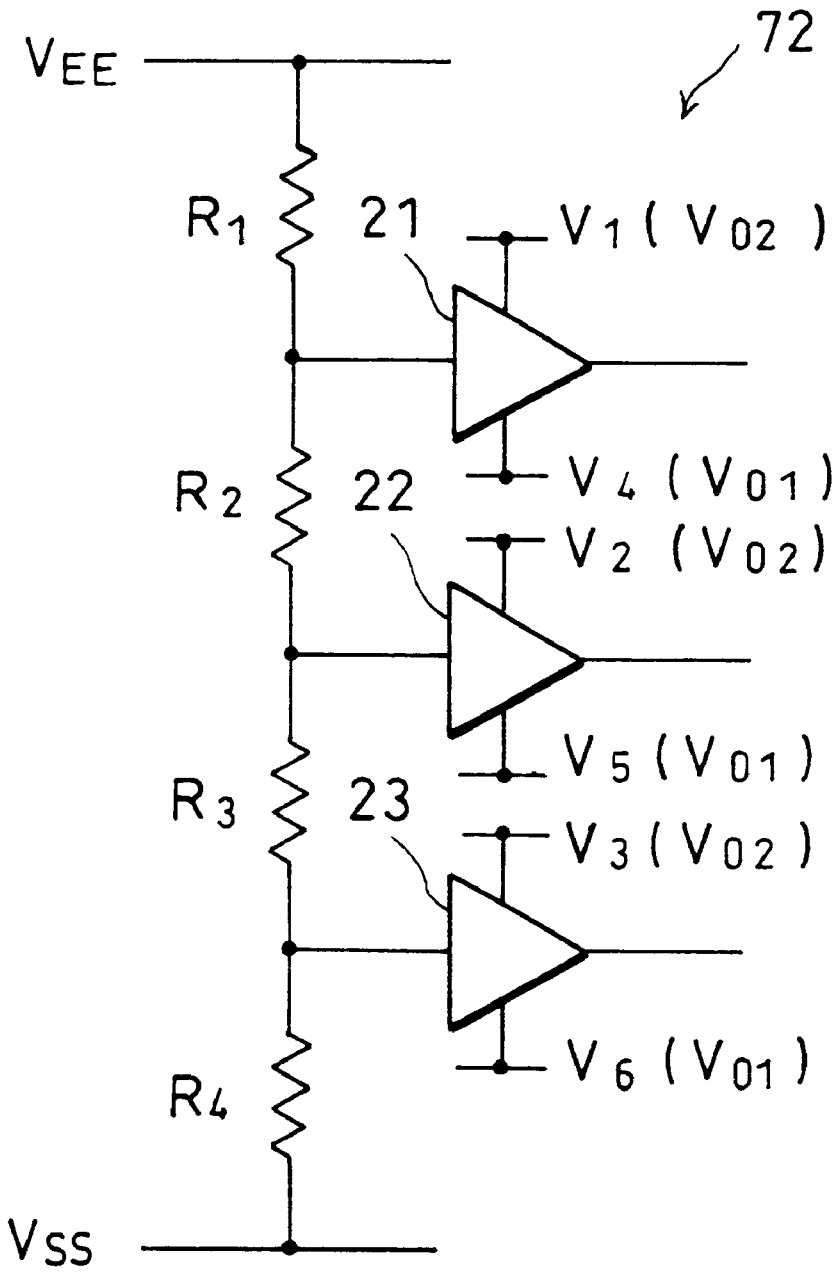
FIG. 2 is a block diagram illustrating an arrangement of a column voltage generating circuit installed in the voltage generating circuit in the matrix-type liquid crystal display device.

In the case where a two-row simultaneous selection driving scheme is applied, three levels are necessary for the column voltages. A column voltage generating circuit 72 for generating column voltages of three levels is equipped with voltage dividing resistors $R_1$ through $R_4$ (second group of voltage dividing resistors) and operational amplifiers 21 through 23 as fourth operational amplifiers, as shown in FIG. 2.

The voltage dividing resistors $R_1$ through $R_4$ are connected in series. A power source potential $V_{EE}$ is applied to an end of the voltage dividing resistor $R_1$, while a power source potential $V_{SS}$, which is lower than the power source potential $V_{EE}$, is applied to an end of the voltage dividing resistor $R_4$. Input terminals of the operational amplifiers 21 through 23 are connected to a junction point between the voltage dividing resistors $R_1$ and $R_2$, a junction point between the voltage dividing resistors $R_2$ and $R_3$, and a junction point between the voltage dividing resistors $R_3$ and $R_4$, respectively. Besides, power source voltages $V_1$ through $V_3$ are applied to positive power source terminals of the operational amplifiers 21 through 23, respectively, while power source voltages $V_4$ through $V_6$ are applied to negative power source terminals of the operational amplifiers 21 through 23, respectively.

In the column voltage generating circuit 72 thus arranged, a potential difference between the reference potential $V_{EE}$ and the reference potential $V_{SS}$ is divided by the voltage dividing resistors $R_1$ through $R_4$. By doing so, voltages at different levels are generated by the column voltage generating circuit 72. The voltages thus generated by the column voltage generating circuit 72 are subjected to the impedance conversion by the operational amplifiers 21 through 23, and are sent to the column electrode driving circuit 3.

Figure 1:
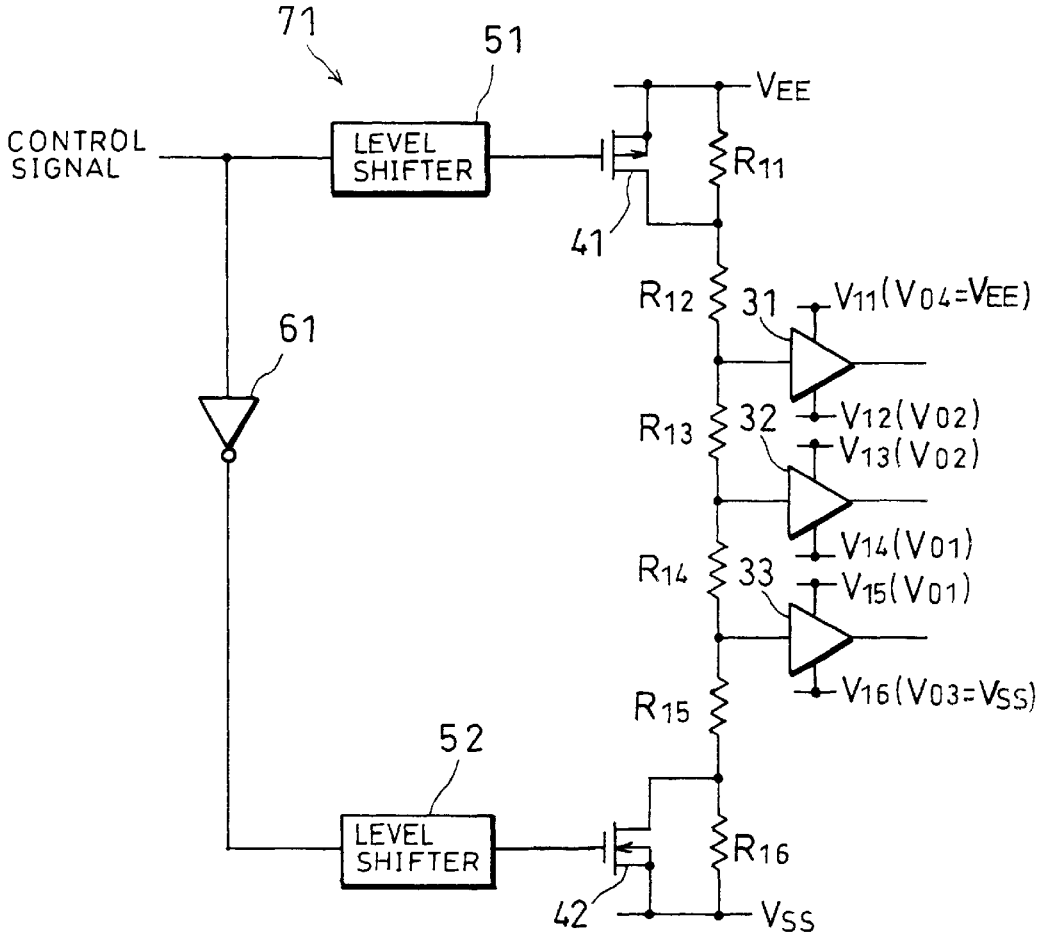
FIG. 1 is a block diagram illustrating an arrangement of a row voltage generating circuit installed in a voltage generating circuit in a simple matrix-type liquid crystal display device in accordance with a first embodiment of the present invention.

The row voltage generating circuit 71 is equipped with voltage dividing resistors $R_{11}$ through $R_{16}$ (first group of voltage dividing resistors), operational amplifiers 31 through 33, a p-channel MOSFET 41, an n-channel MOSFET 42, level shifters 51 and 52, and an inverter 61, as shown in FIG. 1.

The voltage dividing resistors $R_{11}$ through $R_{16}$ are connected in series. The power source potential $V_{EE}$ is applied to an end of the voltage dividing resistor $R_{11}$, while the power source potential $V_{SS}$ is applied to an end of the voltage dividing resistor $R_{16}$. A source and a drain of the p-channel MOSFET 41 are connected to ends of the voltage dividing resistor $R_{11}$, while a source and a drain of the n-channel MOSFET 42 are connected to ends of the voltage dividing resistor $R_{16}$.

Input terminals of the operational amplifiers 31 through 33 are connected to a junction point between the voltage dividing resistors $R_{12}$ and $R_{13}$, a junction point between the voltage dividing resistors $R_{13}$ and $R_{14}$, and a junction point between the voltage dividing resistors $R_{14}$ and $R_{15}$, respectively.

The operational amplifiers 31 and 33 incorporated in the selective voltage generating section 71*a* output voltages serving as a positive selective voltage and a negative selective voltage, respectively. On the other hand, the operational amplifier 32 incorporated in the non-selective voltage generating section 71*b* outputs a voltage serving as a non-selective voltage. Besides, power source voltages $V_{11}$, $V_{13}$, and $V_{15}$ are applied to positive power source terminals of the operational amplifiers 31 through 33, respectively, while power source voltages $V_{12}$, $V_{14}$, and $V_{16}$ are applied to negative power source terminals of the operational amplifiers 31 through 33, respectively.

The operational amplifier 31 functions as a first operational amplifier. The operational amplifier 33 functions as a second operational amplifier. The operational amplifier 32 functions as a third operational amplifier.

A gate of the p-channel MOSFET 41 as connecting means (analog switch) is connected to the level shifter 51. On the other hand, a gate of the n-channel MOSFET 42 as connecting means (analog switch) is connected to the level shifter 52. The level shifter 51 changes a level of a control signal inputted thereto, while the level shifter 52 changes a level of the control signal having been reversed by the inverter 61.

In the row voltage generating circuit 71 arranged as above, a potential difference between the reference potential $V_{EE}$ and the reference potential $V_{SS}$ is divided by the voltage dividing resistors $R_{11}$ through $R_{16}$. By doing so, voltages at different levels are generated by the row voltage generating circuit 71. The voltages thus generated by the row voltage generating circuit 71 are subjected to impedance conversion by the operational amplifiers 31 through 33, and are sent to the row electrode driving circuit 2.

In the row voltage generating circuit 71, the MOSFETs 41 and 42 switch voltage division ratios among the voltage dividing resistors $R_{11}$ through $R_{16}$. Here, in the case where ON-resistances of the MOSFETs 41 and 42 are sufficiently smaller than resistances of the voltage dividing resistors $R_{11}$ and $R_{16}$, levels of the voltages supplied to the row electrode driving circuit 2 are switched to either levels resulting on the voltage division by the voltage dividing resistors $R_{11}$ through $R_{16}$ with respect to a potential difference between the reference potentials $V_{EE}$ and $V_{SS}$, or levels resulting on the voltage division by the voltage dividing resistors $R_{12}$ through $R_{15}$ with respect to the same.

Note that resistances of the voltage dividing resistors $R_{11}$through $R_{16}$ are set so that a voltage outputted as the non-selective voltage is kept constant, irrelevant to the ON- or OFF-state of the MOSFETs 41 and 42.

The above description has explained a case where the row voltage generating circuit 71 has the MOSFETs 41 and 42 as analogue switches or the connecting means, but bipolar transistors may be used in the place of the MOSFETs 41 and 42. Besides, row voltage levels necessary in the case where the row voltage amplitude modulation method is not applied are three levels, that is, a positive selective voltage, a negative selective voltage, and a non-selective voltage. Therefore, a row voltage generating circuit 71 in this case is also arranged as shown in FIG. 2.

In the case where field effect transistors (FET) or bipolar transistors are used as analog switches, it is preferable that sources of the FETs and emitters of the bipolar transistors are connected to stable potentials. In the row voltage generating circuit 71, since a reference potential is applied to each source of the MOSFETs 41 and 42, the source potential is stabilized. Therefore, no circuit is needed for stabilizing the source potential, and hence, it is possible to simplify the circuit arrangement.

Figure 11:
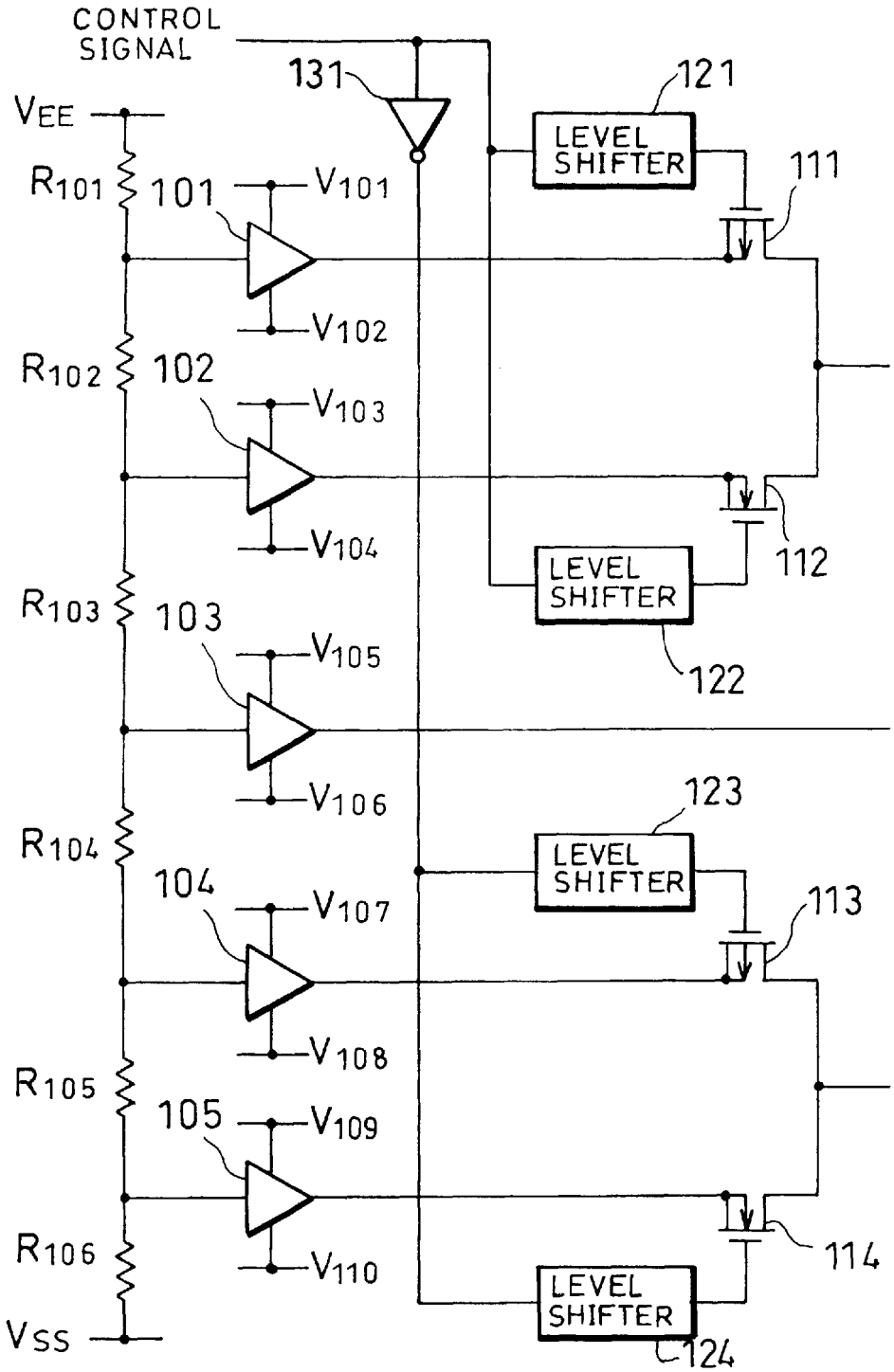
FIG. 11 PRIOR ART
FIG. 11 is a block diagram of a row voltage generating circuit in a conventional matrix-type liquid crystal display device.

In the row voltage generating circuit 71, the numbers of MOSFETs, level shifters, and operational amplifiers are decreased by two each, compared with a conventional row voltage generating circuit (see FIG. 11). With this, reduction of the circuitry scale and reduction of the price of the voltage generating circuit 7 are achieved.

Besides, in the case where the gradation display is executed by the amplitude modulation method, altering the connection states of the voltage dividing resistors $R_{11}$ through $R_{16}$ by the MOSFETs 41 and 42 is preferable, rather than altering the connection states of the voltage dividing resistors $R_1$ through $R_4$. This is because, in an arrangement wherein the connection states of the voltage dividing resistors $R_{11}$through $R_{16}$ are altered, a condenser (not shown) with a desired capacity can be provided at the output stage of the column voltage generating circuit 72 so that the display irregularities due to distortion of the column voltage waveforms can be suppressed. On the other hand, in the arrangement wherein the connection states of the voltage dividing resistors R1 through R4 are altered, a capacity of the condenser which is applied to an output stage of the column voltage generating circuit 72 is limited in the case where the condenser brings about a load when the amplitude changes, and then, display irregularities may occurs.

Furthermore, the above description has explained the case where the two-stage row voltage amplitude modulation method is applied, but the present invention also can be applied in the case where the multi-stage modulation method, the column voltage amplitude modulation method, or a scheme wherein a corrective voltage is superimposed so as to suppress display irregularities is applied. Moreover, in the case where three or more rows are simultaneously selected and the column voltage amplitude modulation method is applied, the number of the column voltage levels increases as the number of the simultaneously selected rows increases. Therefore, in such a case, the parts decreasing effect becomes greater.

Furthermore, it is preferable that the voltage generating circuit 7 is composed of semiconductor integrated circuits (ICs). By doing so, display irregularities due to variations of elements are suppressed, and reduction of the size of the voltage generating circuit 7 and lowering of the price thereof are easily achieved.

The whole voltage generating circuit 7 may be formed into an integrated circuit. Alternatively, either the column voltage generating circuit 72 and the non-selective voltage generating section 71*b* (operational amplifier 32), or the selective voltage generating section 71*a,* or the both, are individually formed into a semiconductor integrated circuit each. This is because the column voltage generating circuit 72 and the non-selective voltage generating section 71*b* have greatly different breakdown resistance from that of the selective voltage generating section 71*a*. Therefore, by arranging the voltage generating circuit 7 so that independence in circuitry of the column voltage generating circuit 72 and the non-selective voltage generating section 71*b* from the selective voltage generation section 71*a* is achieved, the breakdown resistances of the column voltage generating circuit 72 and the non-selective voltage generating section 71*b* can be set lower. By doing so, properties of elements constituting the voltage generating circuit 7 are improved, while power consumption of the voltage generating circuit 7 is reduced.

Figure 4:
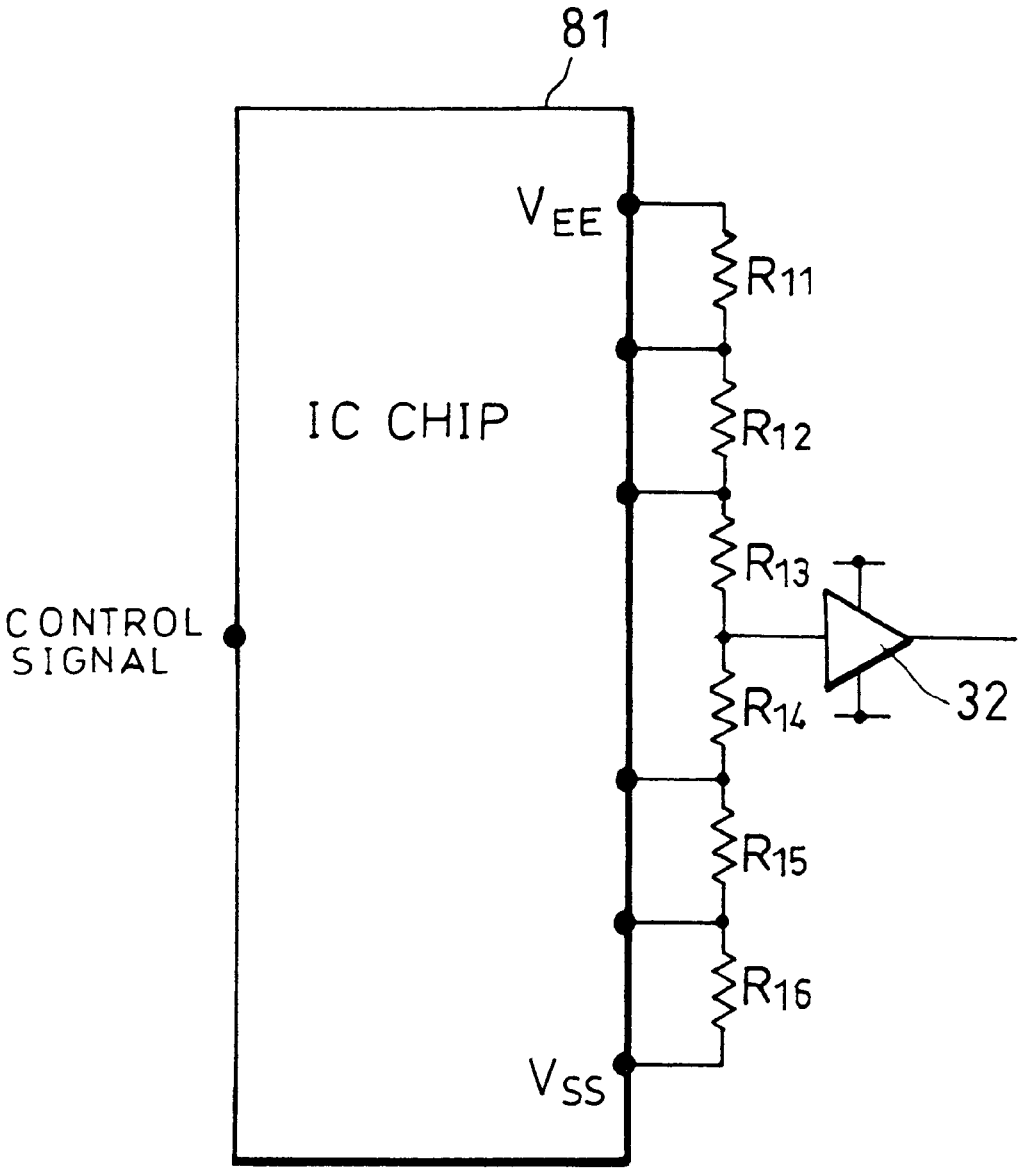
FIG. 4 is a block diagram illustrating an arrangement of the voltage generating circuit incorporating an IC chip.

Specifically, in an arrangement wherein the column voltage generating circuit 72 and the non-selective voltage generating section 71*b* are formed into a semiconductor integrated circuit (hereinafter referred to as semiconductor IC), the selective voltage generating section 71*a* is preferably provided outside the semiconductor IC. Besides, in an arrangement wherein the selective voltage generating section 71*a* is formed into a semiconductor IC, the column voltage generating circuit 72 and the non-selective voltage generating section 71*b* (operational amplifier 32) are preferably formed outside the semiconductor IC. For example, FIG. 4 is an explanatory view illustrating an arrangement wherein the selective voltage generating section 71*a* is formed into an IC chip 81 which is a semiconductor IC. As shown in this figure, in this arrangement, the non-selective voltage generating section 71*b* (operational amplifier 32) is provided outside the IC chip 81.

Furthermore, other operational amplifiers which are not formed into semiconductor ICs may be formed into other semiconductor ICs. For example, as shown in FIG. 5, the selective voltage generating section 71*a* may be formed within the IC chip 81, while the column voltage generating circuit 72 and the non-selective voltage generating section 71*b* may be formed into an IC chip 82, which is another semiconductor IC.

Figure 5:
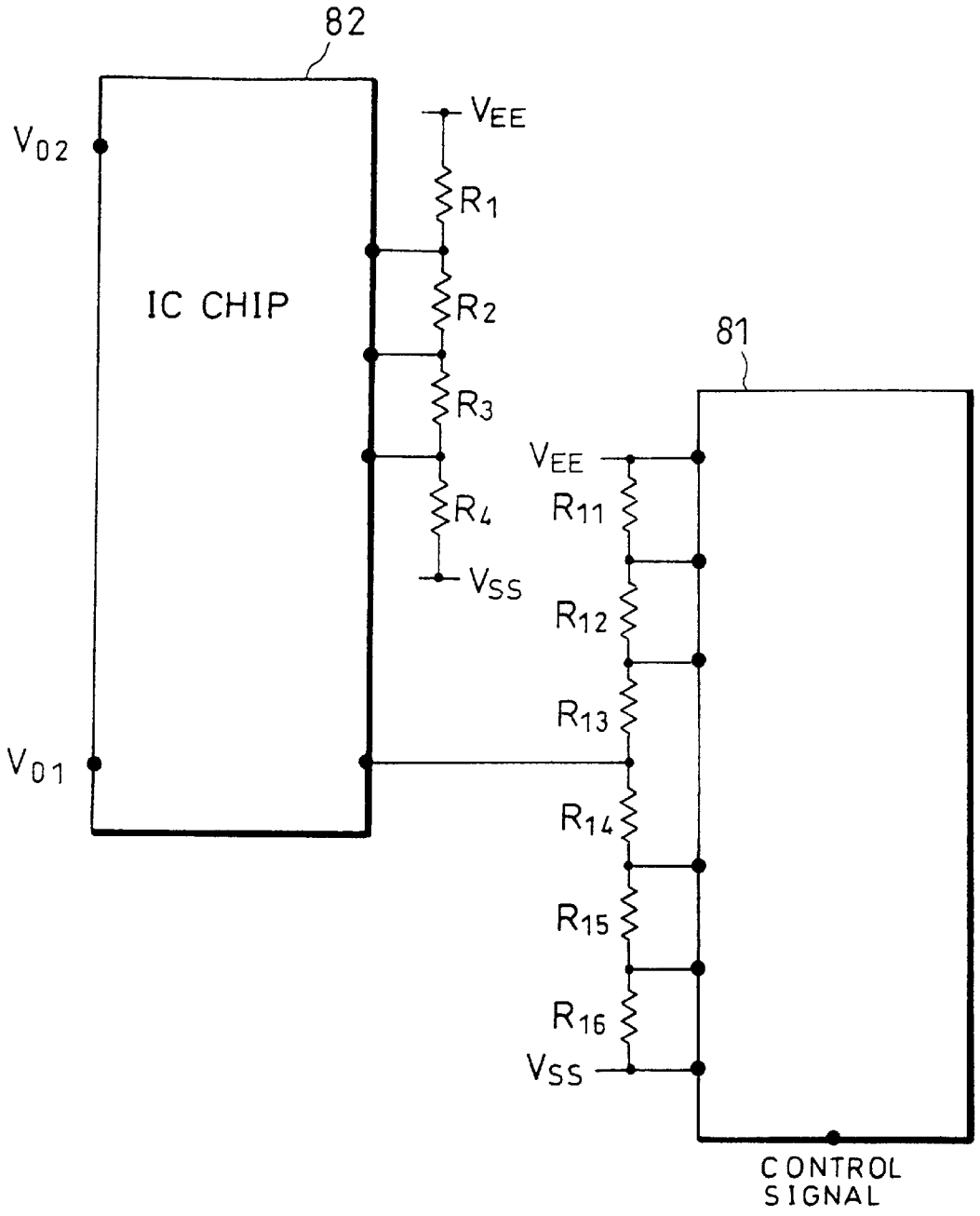
FIG. 5 is a block diagram illustrating another arrangement of the voltage generating circuit incorporating IC chips.

As illustrated in FIGS. 4 and 5, it is preferable that the voltage dividing resistors $R_{11}$ through $R_{16}$ are not installed in the IC chip 81, but are provided outside the IC chip 81, in the case where the selective voltage generating section 71*a* is formed into the IC chip 81. In such an arrangement, the accuracy required of the voltage dividing resistors $R_{11}$ through $R_{16}$, and the voltage division ratio of the voltage dividing resistors $R_{11}$ through $R_{16}$ in the analog switch ON-state and OFF-state, are freely set, by appropriately selecting the voltage dividing resistors $R_{11}$ through $R_{16}$.

Note that, as shown in FIG. 5, the voltage dividing resistors $R_1$ through $R_4$ in the column voltage generating circuit 72 are also preferably provided outside the IC chip 82. In such arrangement, the accuracy and the voltage dividing ratio required of the voltage dividing resistors $R_1$ through $R_4$ are freely set, by appropriately selecting the voltage dividing resistors $R_1$ through $R_4$.

Moreover, the simple matrix-type LCD device in accordance with the present embodiment is equipped with a power source circuit 8 which outputs at least four power source voltages (first through fourth power source voltages) $V_{01}$ through $V_{04}$. The power source voltage $V_{01}$ has a ground level, while the power source voltage $V_{03}$ has a negative level. The power source voltages $V_{02}$ and $V_{04}$ have positive levels, and the power source voltage $V_{02}$ is lower than the power source voltage $V_{04}$. In short, the power source voltages $V_{01}$ through $V_{04}$ are set so as to satisfy the following relationship: $V_{04}$ $(=V_{EE})$ $>V_{02}>V_{01}>V_{03}(=V_{SS})$.

In the column voltage generating circuit 72, the power source voltages $V_1$ through $V_3$ which are supplied to the operational amplifiers 21 through 23, respectively, are the power source voltage $V_{02}$ each, while the power source voltages $V_4$ through $V_6$ are the power source voltage $V_{01}$ each. On the other hand, in the row voltage generating circuit 71, the power source voltages $V_{11}$ and $V_{12}$ supplied to the operational amplifier 31 are the power source voltages $V_{04}$ and $V_{02}$, respectively, the power source voltages $V_{13}$ and $V_{14}$ supplied to the operational amplifier 32 are the power source voltages $V_{02}$ and $V_{01}$, respectively, and the power source voltages $V_{15}$ and $V_{16}$ supplied to the amplifier 33 are the power source voltages $V_{01}$ and $V_{03}$, respectively.

The row electrode driving circuit 2, to which voltages at levels with those of the power source voltages $V_{03}$ and $V_{04}$ are supplied from the row voltage generating circuit 71, is hence driven by power source voltages $V_{03}$ and $V_{04}$. The column electrode driving circuit 3, to which voltages at levels with those of the power source voltages $V_{01}$ and $V_{02}$ are supplied from the column voltage generating circuit 72, is hence driven by power source voltages $V_{01}$ and $V_{02}$.

In the above arrangement, two voltages to be supplied to any one of the operational amplifiers 21 through 23 and 31 through 33 are selected among the four power source voltages $V_{01}$ through $V_{04}$ so that a potential difference between the two selected is minimum. On the other hand, if, for example, the power source voltages $V_{03}$ and $V_{04}$, or the power source voltages $V_{01}$ and $V_{04}$, are used for driving the operational amplifier 31, a potential difference between the two used power source voltages is greater than that of the above arrangement, and power consumption increases. Therefore, with the above arrangement, it is possible to reduce the power consumption of the voltage generating circuit 7.

Second Embodiment

The following description will explain a second embodiment of the present invention. The members having the same structure (function) as those in the above-mentioned embodiment will be designated by the same reference numerals and their description will be omitted.

Figure 6:
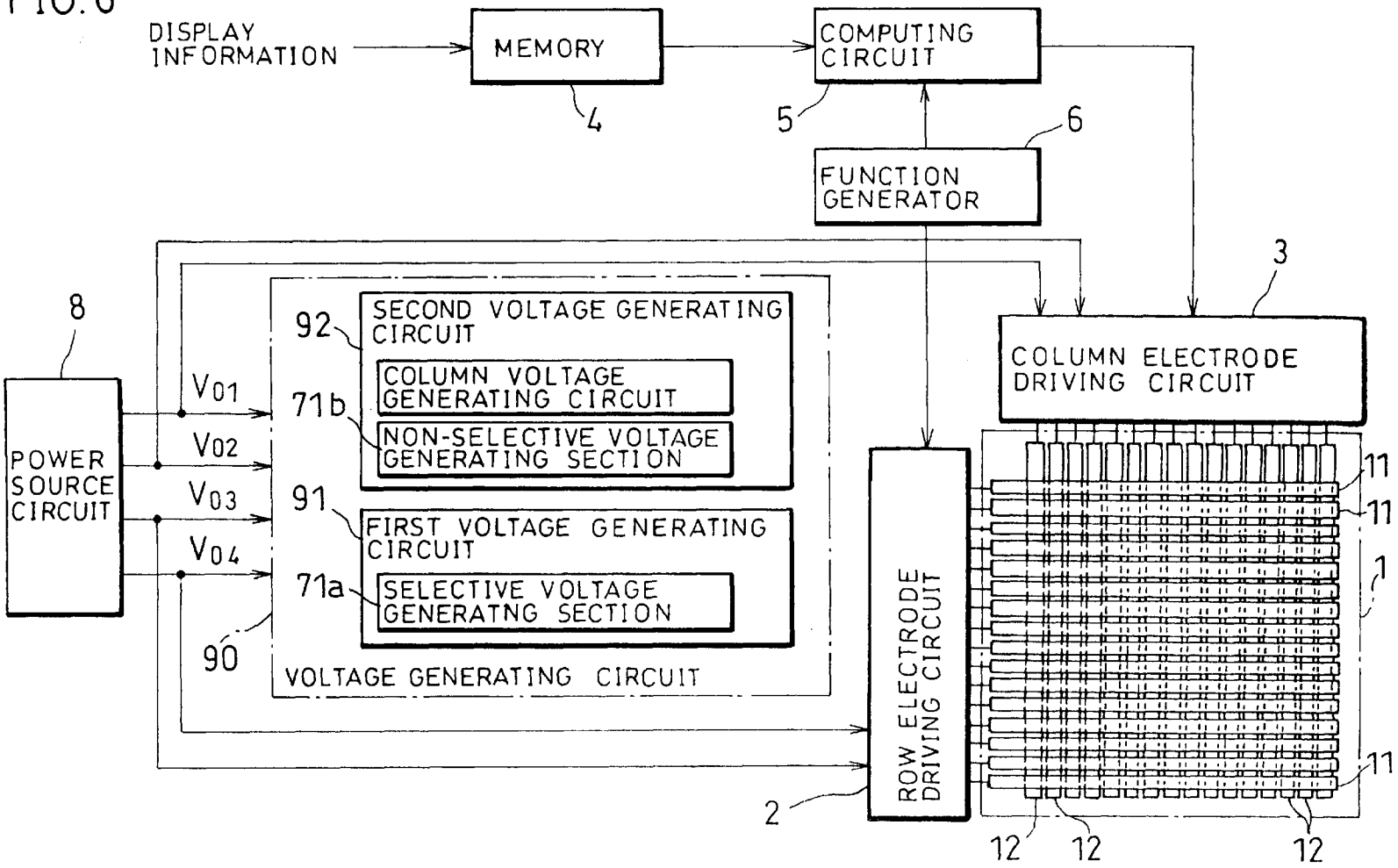
FIG. 6 is an explanatory view illustrating an arrangement of a simple matrix-type liquid crystal display device in accordance with the second embodiment of the present invention.

FIG. 6 is an explanatory view illustrating an arrangement of a simple matrix-type liquid crystal display device in accordance with the present embodiment (hereinafter referred to as the present display device). As shown in this figure, the present display device has the same arrangement as the matrix-type display device shown in FIG. 3, except that a voltage generating circuit 90 is provided instead of the voltage generating circuit 7.

The voltage generating circuit 90 is equipped with a first voltage generating circuit (first voltage generating means) 91 and a second voltage generating circuit (second voltage generating means) 92. The first voltage generating circuit 91 is equipped with the selective voltage generating section 71*a*, while the second voltage generating circuit 92 is equipped with the non-selective voltage generating section 71*b* and the column voltage generating circuit 72.

Figure 7:
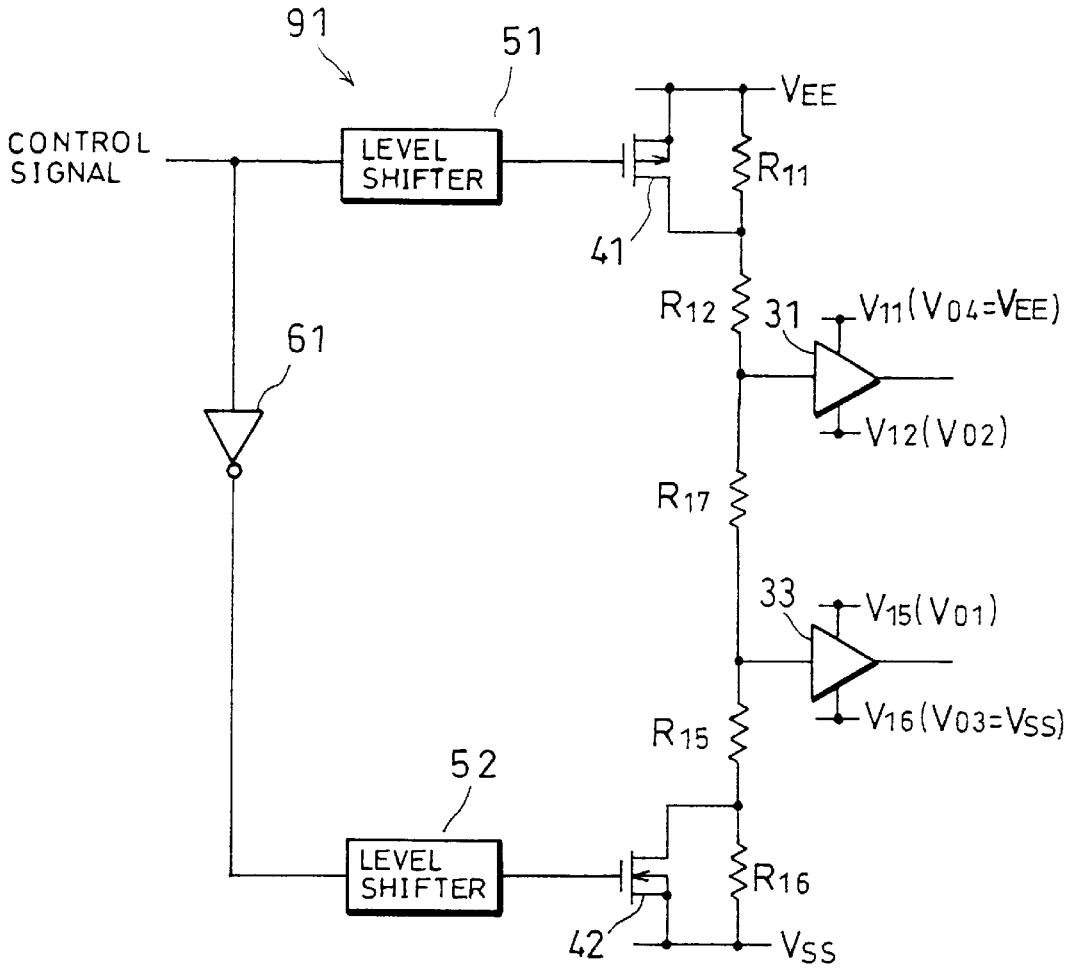
FIG. 7 is an explanatory view illustrating an arrangement of a first voltage generating circuit installed in a voltage generating circuit of the simple matrix-type liquid crystal display device shown in FIG. 6.

FIG. 7 is an explanatory view illustrating an arrangement of the first voltage generating circuit 91. As shown in this figure, the first voltage generating circuit 91 has the same arrangement as that of the row voltage generating circuit 71 shown in FIG. 1 except that the dividing voltage resistor $R_{14}$ and the operational amplifier 32 are omitted and a dividing voltage resistor $R_{17}$ is provided instead of the voltage dividing resistor $R_{13}$. The first voltage generating circuit 91 is arranged so that outputs from the operational amplifiers 31 and 33 are supplied to the row electrode driving circuit 2 shown in FIG. 6, so that the outputs are applied as selective voltages to selected row electrodes for display.

Figure 8:
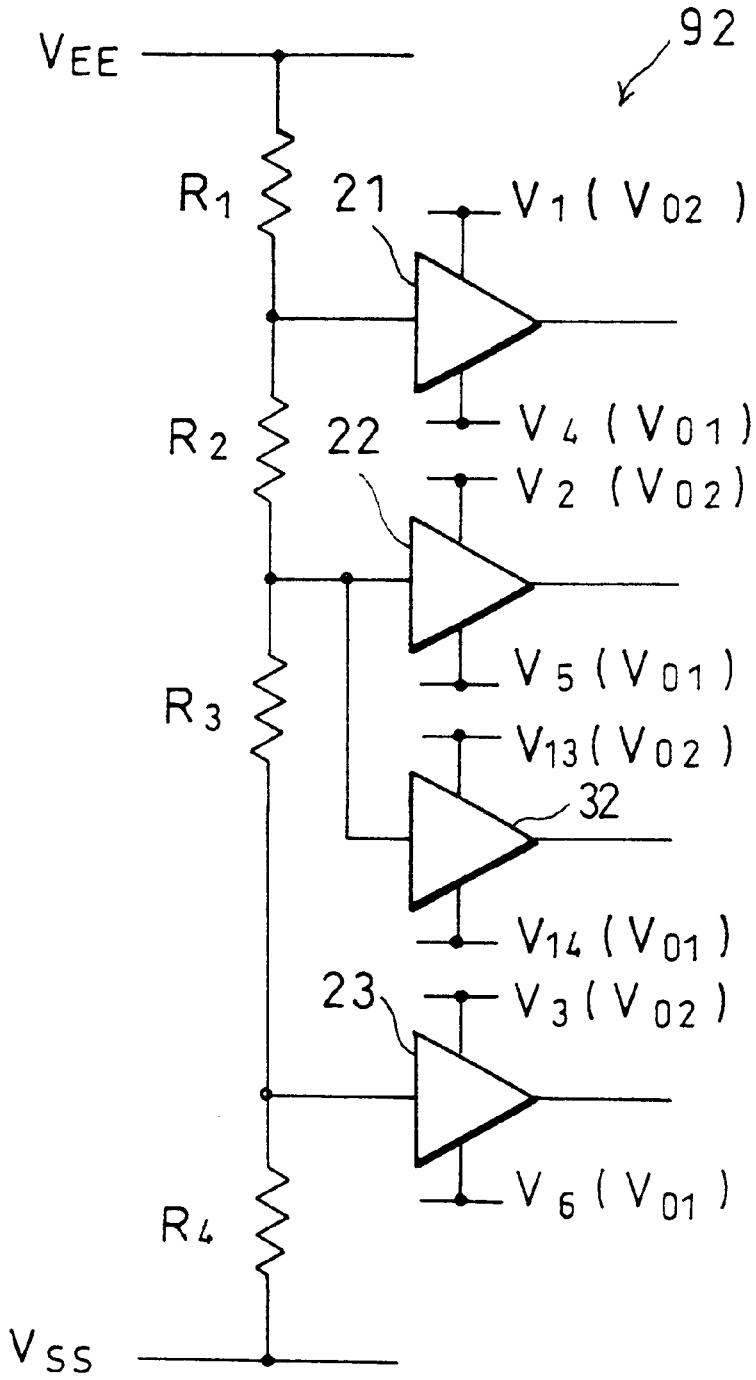
FIG. 8 is an explanatory view illustrating an arrangement of a second voltage generating circuit installed in a voltage generating circuit of the simple matrix-type liquid crystal display device shown in FIG. 6.

FIG. 8 is an explanatory view illustrating an arrangement of the second voltage generating circuit 92. As shown in this figure, the second voltage generating circuit 92 has the same arrangement as that of the column voltage generating circuit 72 except that the operational amplifier 32 is provided therein parallel with the operational amplifier 22. Thus, in the second voltage generating circuit 92, the same voltage signal is supplied to the operational amplifier 22 and the operational amplifier 32, and an output of the operational amplifier 32 is supplied to the row electrode driving circuit 2 so that the output is applied as a non-selective voltage to row electrodes not selected for display. Besides, as the column voltage generating circuit 72 shown in FIG. 2, the outputs of the operational amplifiers 21 through 23 are supplied to the column electrode driving circuit 3 shown in FIG. 6.

Thus, the present display device is arranged so that in the first voltage generating circuit 91, only selective voltages are generated by the use of the voltage dividing resistors $R_{11}$, $R_{12}$, and $R_{15}$ through $R_{17}$ (third group of voltage dividing resistors), while in the second voltage generating circuit 92, a non-selective voltage is generated by the use of one of the voltages generated by the voltage dividing resistors $R_1$ through $R_4$ (fourth group of voltage dividing resistors). With this arrangement, the number of the resistors in the first voltage generating circuit 91 can be decreased by one, as compared with the case where row and column voltages are generated by the row voltage generating circuit 71 and the column voltage generating circuit 72. In short, the junction point between $R_{13}$ and $R_{14}$ in the arrangement shown in FIG. 1 becomes unnecessary, and the voltage dividing resistor $R_{17}$ which has a resistance equal to the sum of the resistances of the voltage dividing resistors $R_{13}$ and $R_{14}$ is used in the place of the voltage dividing resistors $R_{13}$ and $R_{14}$. Therefore, the number of the resistors can be decreased. Moreover, in the case where the second voltage generating circuit 92 is formed into a semiconductor IC, the number of necessary pins can be decreased.

Besides, since the operational amplifier 32 is driven by the same power source voltage as that for the operational amplifiers 21 through 23, it is unnecessary to supply the second voltage generating circuit 92 with a different power source voltage from that for the column voltage generating circuit 72. Moreover, the first voltage generating circuit 91 no longer needs a power source voltage for the operational amplifier 32 in the row voltage generating circuit 71. Therefore, in the case where the first voltage generating circuit 91 and the second voltage generating circuit 92 are independently provided as described later, the voltage generating circuit 90 has a smaller number of necessary power source voltages than that of the voltage generating circuit 7.

Since the voltage generating circuit 90 is thus arranged, costs for manufacturing and usage of the same are less than those for the voltage generating circuit 7.

Furthermore, it is easier to form a circuit, with the selective voltage generating section 71*a* being completely separated from the second voltage generating circuit 92 and the non-selective voltage generating section 71*b*. As is the case with the voltage generating circuit 7 of the first embodiment, the voltage generating circuit 90 is preferably composed of semiconductor ICs. By doing so, irregularities due to variations of elements are suppressed, and reduction of the size of the voltage generating circuit 90 and reduction of manufacturing costs thereof are achieved. Moreover, as shown in the first embodiment, the column voltage generating circuit 72 and the non-selective voltage generating section 71*b* have greatly different breakdown resistance from the selective voltage generating section 71*a*. Therefore, they are preferably formed into circuits which are separately provided.

Figure 9:
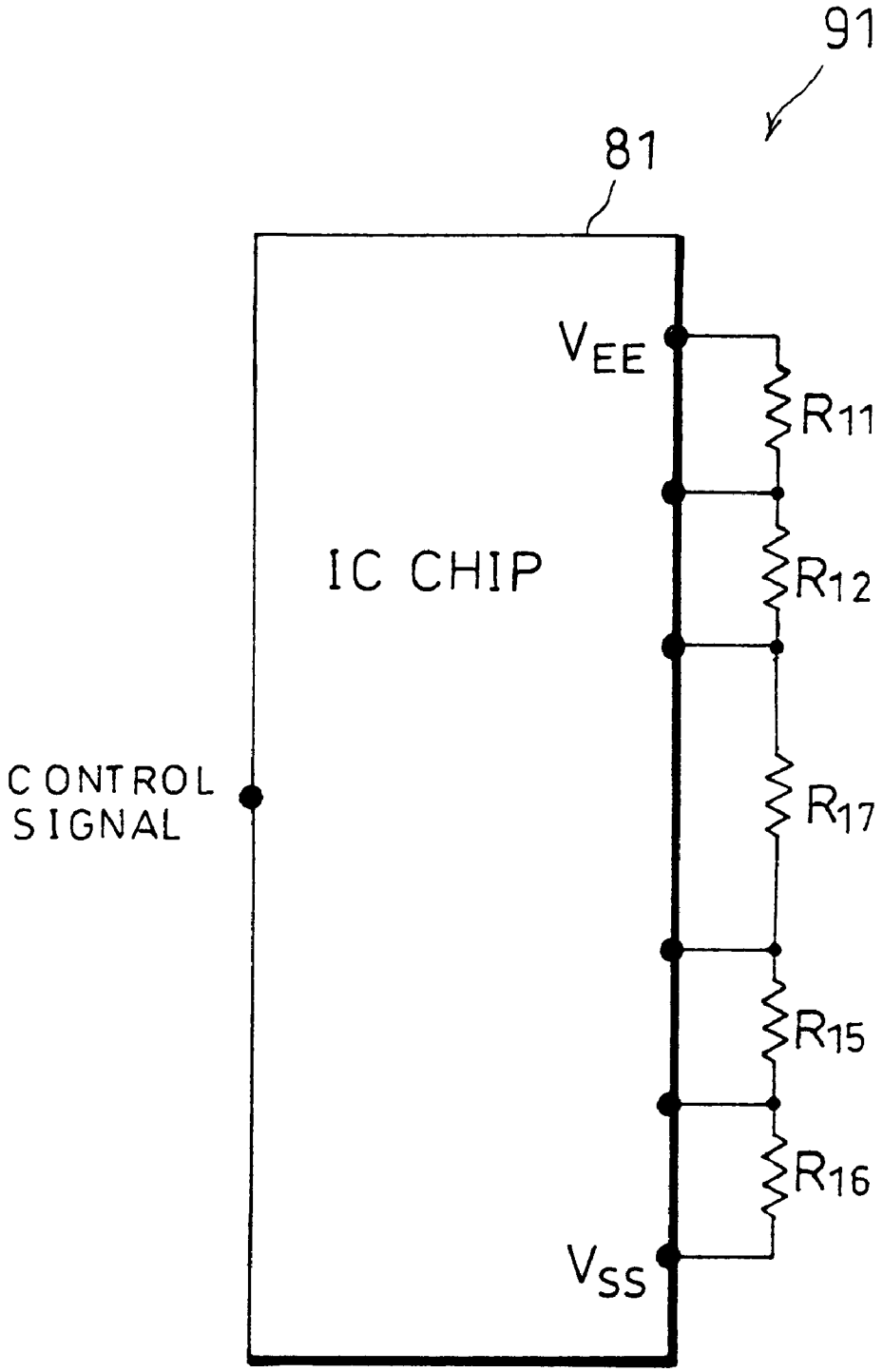
FIG. 9 is an explanatory view illustrating an arrangement of the first voltage generating circuit shown in FIG. 7 in the case where it is formed into an IC chip.

FIG. 9 shows an arrangement wherein the first voltage generating circuit 91 is formed on the IC chip 81, and voltage dividing resistors $R_{11}$, $R_{12}$, and $R_{15}$ through $R_{17}$ are provided outside there. In such an arrangement, the second voltage generating circuit 92 is provided outside the IC chip 81. In this case, for example as shown in FIG. 10, the second voltage generating circuit 92 is preferably provided on the IC chip 82.

Thus, in the case where the semiconductor ICs are used, the voltage dividing resistors $R_{11}$, $R_{12}$, and $R_{15}$ through $R_{17}$, and the voltage dividing resistors $R_1$ through $R_4$ are preferably provided outside the IC chips 81 and 82. This is because, as made clear in the first embodiment, by doing so it becomes easier to change the accuracy and the voltage dividing ratio required of the voltage dividing resistors $R_{11}$, $R_{12}$, and $R_{15}$ through $R_{17}$, and the voltage dividing resistors $R_1$ through $R_4$. It should be noted that in the case of this arrangement, (1) the first voltage generating circuit 91 and the voltage dividing resistors $R_{11}$, $R_{12}$, and $R_{15}$ through $R_{17}$ and (2) the second voltage generating circuit 92 and the voltage dividing resistors $R_1$ through $R_4$ can be provided close to each other on the IC chips 81 and 82.

Figure 10:
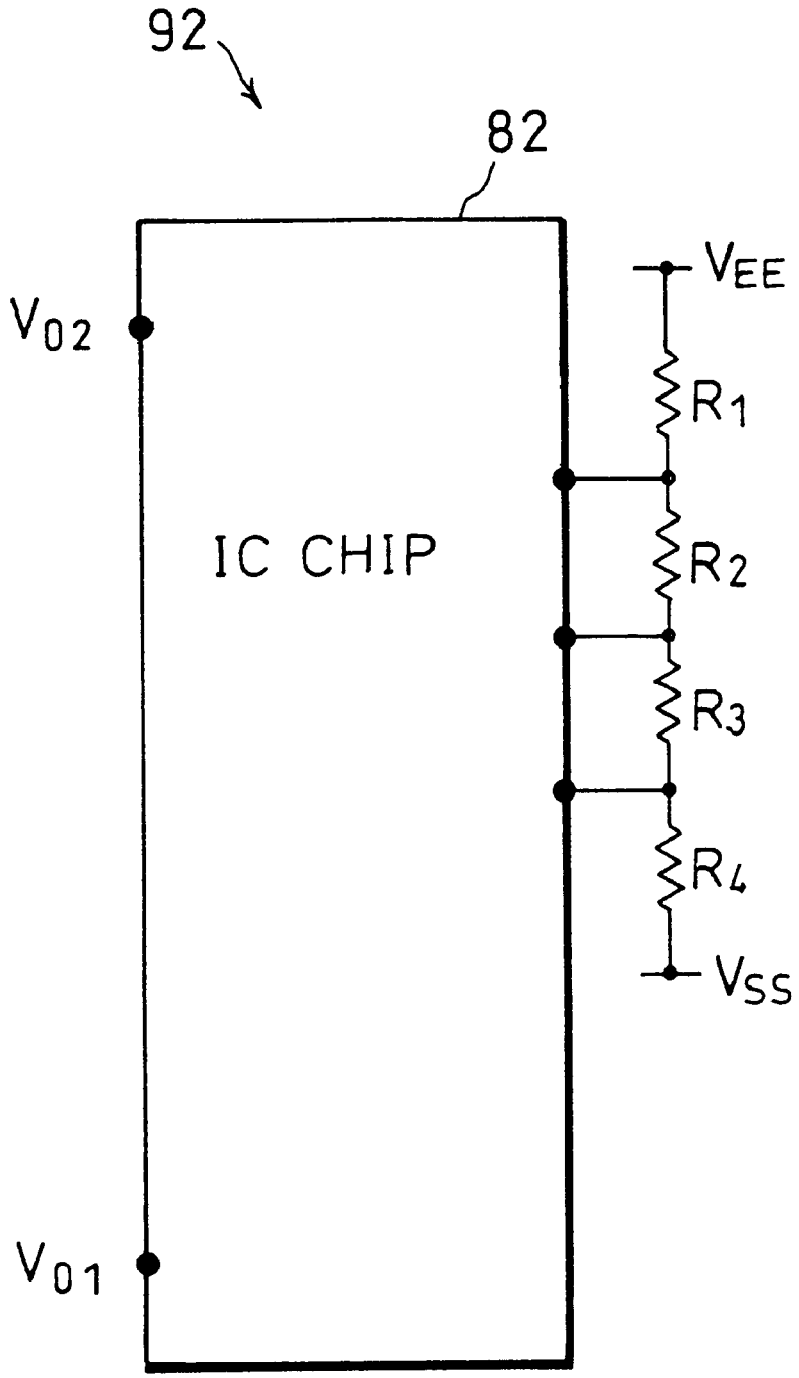
FIG. 10 is an explanatory view illustrating an arrangement of the second voltage generating circuit shown in FIG. 8 in the case where it is formed into an IC chip.

Besides, wiring from a junction point between the voltage dividing resistors $R_{13}$ and $R_{14}$ on the IC chip 81 to the IC chip 82 in the arrangement shown in FIG. 5 is unnecessary in the arrangement shown in FIGS. 9 and 10. Therefore, layout of the substrate of the arrangement shown in FIGS. 9 and 10 is simpler than that of the arrangement shown in FIG. 5.

Note that in the present display device as shown in FIG. 6, one column voltage level is preferably equal to the non-selective voltage level. In this case, an input voltage can be supplied to the operational amplifier 22 and the operational amplifier 32 through the same voltage dividing point (junction point). Besides, in the case where the operational amplifier 22 has sufficient power supplying ability, the operational amplifier 32 may be omitted, while the operational amplifier 22 may be made to have the function of the non-selective voltage generating section 71*b*. In other words, an output of the operational amplifier 22 may be supplied as a column voltage to the column voltage driving circuit 3, while it may be supplied as a non-selective voltage to the row electrode driving circuit 2. In this case, the second voltage generating circuit 92 has an arrangement shown in FIG. 2, whereby the manufacturing costs of the present display device can be further reduced.

Generally, in the case where the number of the simultaneously selected row electrodes is an even number (two in the present display device), the number of the levels of the column voltage is an odd number, and an intermediate level among them may be set equal to the level of the non-selective voltage. On the other hand, in the case where the number of the simultaneously selected row electrodes is an odd number, the number of the levels of the column voltage is an even number, and it is impossible to generate a column voltage equal to the non-selective voltage. However, by finding a mean value of two intermediate levels, this mean level may be set equal to the level of the non-selective voltage.

Besides, since the two-row simultaneous selection driving scheme is applied to the present display device, in the arrangement of the second voltage generating circuit 92 shown in FIG. 10, the level of the non-selective voltage is equal to a level of the column voltage generated at the junction point between the voltage dividing resistors $R_2$ and $R_3$ in FIG. 10. Therefore, the same output pin can be used as an output point of these non-selective and column voltages. By doing so, the number of pins necessary for the IC chip 82 can be decreased.

It should be noted that instead of providing analog switches in parallel with $R_{11}$ and $R_{16}$, respectively, an analog switch may be provided in parallel with $R_{17}$. In this case, voltages can be switched at a specific ratio like the aforementioned arrangement, and hence the following advantages can be achieved. Namely, usually an ON resistance of the FET used as the analog switch and a saturation voltage of the bipolar transistor vary depending on whether the transistor used is the p-type or the n-type. However, such a difference does not affect the potential balance in this arrangement.

As has been described, the driving voltage generating circuit in accordance with the first or second embodiment for use in a matrix-type display device incorporating electrode driving means for driving row electrodes and column electrodes provided in a matrix form so as to carry out display with use of pixels formed at crossing points of the row and column electrodes, the driving voltage generating circuit including voltage generating means which is provided with a plurality of voltage dividing resistors for dividing a predetermined reference voltage so as to generate voltages at a plurality of levels, which are used for driving the row electrodes and the column electrodes, the driving voltage generating circuit is characterized in comprising connecting means for connecting and disconnecting a specific voltage dividing resistor with the other voltage dividing resistors.

In the above arrangement, the voltage levels obtained from the voltage dividing resistors when the specific voltage dividing resistor is connected with the other voltage dividing resistors are different from those when the specific voltage dividing resistor is disconnected with the others. In other words, voltages of different levels are outputted from the same junction point of adjacent voltage dividing resistors. Therefore, the number of circuits provided behind the voltage dividing resistors, for example, operational amplifiers for impedance conversion, may be smaller than the number of the voltages. As a result, reduction of the size of the driving voltage generating circuit, and lowering of the price thereof can be achieved.

Furthermore, the connecting means preferably includes an analog switch for short-circuiting and disconnecting ends of the specific voltage dividing resistor in response to a control signal, the analog switch being provided in parallel with the specific voltage dividing resistor.

In this arrangement, the ends of the specific voltage dividing resistor are short-circuited and non-short-circuited by on/off operations of the analog switch in response to the control signal. Therefore, a least necessary number of analog switches are provided, irrespective of the number of the voltage dividing resistors. Therefore, the number of the analog switches does not vary depending on the number of output voltages, unlike the conventional arrangement wherein analog switches are used for switching output voltages of a voltage dividing circuit composed of voltage dividing resistors, at a rear stage of the voltage dividing circuit. As a result, the size of the driving voltage generating circuit can be reduced, and the price thereof can be lowered.

In addition, the analog switches are preferably provided in parallel with, among the voltage dividing resistors, those to which the reference voltage is directly applied.

In this arrangement, the analog switches are connected to two voltage dividing resistors to which a potential at a low level and a potential at a high level for supplying a reference voltage are applied, respectively. Therefore, for example, by controlling the operation of the analog switch provided in parallel with the resistor to which the above two potentials are supplied, voltages at three levels are switched at a specific ratio. Besides, a reference voltage is applied to the analog switches as well. Therefore, a field effect transistor (FET) or a bipolar transistor whose source or emitter is preferably connected with a stable potential can be easily used as the analog switch. The circuit thus arranged is therefore simpler, as compared with a circuit wherein an analog switch is provided in parallel with a voltage dividing resistor to which a reference voltage is not applied. As a result, it is possible to easily provide a circuit which is suitable for generating row voltages of three levels, that is, positive and negative selective voltages and non-selective voltage.

Moreover, the driving voltage generating circuit of the matrix-type display device of the present invention is preferably, in whole or in part, composed of a semiconductor integrated circuit. With this arrangement, variation of elements in the voltage generating means is decreased, and display irregularities due to the variation are suppressed. Therefore, reduction of the size of the driving voltage generating circuit, reduction of the price thereof, and lowering of power consumption are further promoted, while improvement of display quality is achieved.

In addition, in this arrangement, the voltage generating means preferably includes (1) selective voltage generating means for generating a selective voltage to be applied to a row electrode which is selected for display, based on an output voltage at a predetermined level which is supplied from the voltage dividing resistors, (2) non-selective voltage generating means for generating a non-selective voltage to be applied to a row electrode which is not selected for display, based on a voltage at a predetermined level which is supplied from the voltage dividing resistors, and (3) column voltage generating means for generating column voltages to be applied to the column electrodes, based on voltages supplied from the voltage dividing resistors, each column voltage being set to a level in accordance with the selective voltage and display information, wherein at least either a part composed of the column voltage generating means and the non-selective voltage generating means, or the selective voltage generating means, is formed into a semiconductor integrated circuit. Normally, the selective voltage is set to a higher level, as compared with the column voltage and the non-selective voltage. Therefore, the breakdown resistance of the column voltage generating means and that of the non-selective voltage generating means are preferably different from that of the selective voltage generating means. For this reason, in the case where the column voltage generating means, the non-selective voltage generating means, and the selective voltage generating means are formed into a semiconductor IC, the breakdown resistances of the column voltage generating means and the non-selective voltage generating means are set unnecessarily higher. Therefore, the structures of insulating layers and the like of the column voltage generating means and the non-selective voltage generating means are made so as to match the structure of the selective voltage generating means, thereby resulting in that extra manufacturing costs being spent.

In contrast, in the aforementioned arrangement, a part composed of the column voltage generating means and the non-selective voltage generating means is separated from the selective voltage generating means, and either of them is formed into a semiconductor IC, or the both are separately formed into semiconductor ICs. By doing so, breakdown resistances thereof are set different from each other. Therefore, by setting appropriate breakdown resistances, enhancement of properties of the elements and lowering of power consumption can be achieved.

Besides, in the case where semiconductor ICs are used for forming the driving voltage generating circuit of the matrix-type display device of the present invention, the voltage dividing resistors are preferably provided outside the semiconductor ICs. Since in this arrangement the resistors are provided outside, it is possible to freely set the accuracy required of the voltage dividing resistors, a voltage dividing ratio when the specific voltage dividing resistor is connected with the others by the connecting means or the analog switch, and that when disconnected. Therefore, the degree of freedom in designing of the driving voltage generating circuit composed of semiconductor ICs can be improved.

Furthermore, in the driving voltage generating circuit of the matrix-type display device of the present invention, the voltage generating means includes (1) first and second operational amplifiers for generating a positive selective voltage and a negative selective voltage, respectively, by subjecting output voltages at predetermined levels outputted by the voltage dividing resistors to impedance conversion, each of the positive and negative selective voltages being to be applied to a row electrode which is selected for display, (2) a third operational amplifier for generating a non-selective voltage by subjecting an output voltage at a predetermined level outputted by the voltage dividing resistors to impedance conversion, the non-selective voltage being to be applied to each row electrode which is not selected for display, and (3) a fourth operational amplifier for generating column voltages by subjecting output voltages supplied from the voltage dividing resistors to impedance conversion, each column voltage being set to a level in accordance with the selective voltage and display information and being to be applied to each column electrode, wherein (i) the third and fourth operational amplifiers are driven with use of a first power source voltage at a ground level and a second power source voltage at a positive level, (ii) the first operational amplifier is driven with use of the second power source voltage and a fourth power source voltage at the highest level, and (iii) the second operational amplifier is driven with use of the first power source voltage and a third power source voltage at a negative level.

With the above arrangement, if the first through fourth power source voltages are represented as $V_{01}$ through $V_{04}$ respectively, they satisfy the following relationship:

$V_{04}>V_{02}V_{01}>V_{03}$

Therefore, each operational amplifier is supplied with two power source voltages which are those neighboring to each other among the above four in a row. Therefore, a potential difference between power source voltages applied to each of the first through fourth operational amplifiers becomes small, thereby causing the power consumption of each operational amplifier. Therefore, the lowering of power consumption of the driving voltage generating circuit can be further promoted.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A driving voltage generating circuit for use in a matrix-type display device including an electrode driver for driving row electrodes and column electrodes provided in a matrix form so as to carry out display with use of pixels, a pixel being formed at each crossing point of the row and column electrodes, said driving voltage generating circuit comprising:

a voltage generator for feeding voltage at a plurality of levels to said electrode driver, the voltages being used for driving the row electrodes and the column electrodes, said voltage generator including a plurality of voltage dividing resistors for outputting voltages at levels in accordance with connection states thereof from junction points thereof by dividing a predetermined reference voltage; and connecting means for changing the connection states of said voltage dividing resistors so as to change the respective levels of the voltages outputted from the junction points between said voltage dividing resistors, said voltage dividing resistors are grouped into first and second groups, said first group including said voltage dividing resistors generating row voltages applied to said row electrodes, said second group including said voltage dividing resistors generating column voltages applied to said column electrodes, said connecting means changing the connection states of said voltage dividing resistors in said first group, said connecting means connects or disconnects a specific voltage dividing resistor with said other voltage dividing resistors, said connecting means including an analog switch for short-circuiting ends of said specific voltage dividing resistor in response to a control signal, said analog switch being provided in parallel with said specific voltage dividing resistor, wherein said voltage dividing resistors of said first group are connected with each other in series, and the reference voltages are applied to ends of said voltage dividing resistors of said first group, wherein said specific voltage dividing resistors are two voltage dividing resistors positioned at the ends of said first group, and wherein said analog switch is only two analog switches, each is provided in parallel with an associated one of said two voltage dividing resistors.

2. A driving voltage generating circuit for use in a matrix-type display device including an electrode driver for driving row electrodes and column electrodes provided in a matrix form so as to carry out display with use of pixels, a pixel being formed at each crossing point of the row and column electrodes, said driving voltage generating circuit comprising:

a voltage generator for feeding voltage at a plurality of levels to said electrode driver, the voltages being used for driving the row electrodes and the column electrodes, said voltage generator including a plurality of voltage dividing resistors for outputting voltages at levels in accordance with connection states thereof from junction points thereof by dividing a predetermined reference voltage; and connecting means for changing the connection states of said voltage dividing resistors so as to change the respective levels of the voltages outputted from the junction points between said voltage dividing resistors, said voltage dividing resistors are grouped into first and second groups, said first group including said voltage dividing resistors generating row voltages applied to said row electrodes, said second group including said voltage dividing resistors generating column voltages applied to said column electrodes, said connecting means changing the connection states of said voltage dividing resistors in said first group, said connecting means connects or disconnects a specific voltage dividing resistor with said other voltage dividing resistors, said connecting means including an analog switch for short-circuiting ends of said specific voltage dividing resistor in response to a control signal, said analog switch being provided in parallel with said specific voltage dividing resistor, wherein said voltage dividing resistors of said first group are connected with each other in series, and the reference voltages are applied to ends of said voltage dividing resistors of said first group, wherein said specific voltage dividing resistors are two voltage dividing resistors positioned at the ends of said first group, and wherein said analog switch is provided in parallel with each of said specific voltage dividing resistors, and wherein said analog switch is composed of a metal oxide semiconductor-type field effect transistor.

3. A driving voltage generating circuit for use in a matrix-type display device including an electrode driver for driving row electrodes and column electrodes provided in a matrix form so as to carry out display with use of pixels, a pixel being formed at each crossing point of the row and column electrodes, said driving voltage generating circuit comprising:

a voltage generator for feeding voltage at a plurality of levels to said electrode driver, the voltages being used for driving the row electrodes and the column electrodes, said voltage generator including a plurality of voltage dividing resistors for outputting voltages at levels in accordance with connection states thereof from junction points thereof by dividing a predetermined reference voltage; and connecting means for changing the connection states of said voltage dividing resistors so as to change the respective levels of the voltages outputted from the junction points between said voltage dividing resistors, said voltage dividing resistors being grouped into third and fourth groups, said third group including said voltage dividing resistors generating a selective voltage applied to row electrodes selected for display, said fourth group including said voltage dividing resistors generating a non-selective voltage applied to row electrodes not selected for display, and column voltages applied to said column electrodes, each column voltage being set to a level in accordance with the selective voltage and display information, said connecting means changing the connection states of said voltage dividing resistors of said third group, said voltage generator including a first voltage generating means including said third group of said voltage dividing resistors, for generating the selective voltage based on a voltage at a predetermined level supplied from said third group of said voltage dividing resistors; and a second voltage generating means including said fourth group of said voltage dividing resistors, for generating the non-selective voltage and the column voltages, based on a voltage at a predetermined level supplied from said fourth group of said voltage dividing resistors, said connecting means connecting or disconnecting one specific voltage dividing resistor to or from said other voltage dividing resistors, said connecting means including an analog switch for short-circuiting ends of said specific voltage dividing resistor in response to a control signal, said analog switch being provided in parallel with said specific voltage dividing resistor, and wherein said voltage dividing resistors of said third group are connected in series, and the reference voltages are applied to ends of said third group of said voltage dividing resistors;

said specific voltage dividing resistors are two voltage dividing resistors positioned at the ends of said third group; and said analog switch is only two analog switches, each is provided in parallel with an associated one of said two dividing resistors.

4. A driving voltage generating circuit for use in a matrix-type display device including an electrode driver for driving row electrodes and column electrodes provided in a matrix form so as to carry out display with use of pixels, a pixel being formed at each crossing point of the row and column electrodes, said driving voltage generating circuit comprising:

a voltage generator for feeding voltage at a plurality of levels to said electrode driver, the voltages being used for driving the row electrodes and the column electrodes, said voltage generator including a plurality of voltage dividing resistors for outputting voltages at levels in accordance with connection states thereof from junction points thereof by dividing a predetermined reference voltage; and connecting means for changing the connection states of said voltage dividing resistors so as to change the respective levels of the voltages outputted from the junction points between said voltage dividing resistors, said voltage dividing resistors being grouped into third and fourth groups, said third group including said voltage dividing resistors generating a selective voltage applied to row electrodes selected for display, said fourth group including said voltage dividing resistors generating a non-selective voltage applied to row electrodes not selected for display, and column voltages applied to said column electrodes, each column voltage being set to a level in accordance with the selective voltage and display information, said connecting means changing the connection states of said voltage dividing resistors of said third group, said voltage generator including a first voltage generating means including said third group of said voltage dividing resistors, for generating the selective voltage based on a voltage at a predetermined level supplied from said third group of said voltage dividing resistors; and a second voltage generating means including said fourth group of said voltage dividing resistors, for generating the non-selective voltage and the column voltages, based on a voltage at a predetermined level supplied from said fourth group of said voltage dividing resistors, said connecting means connecting or disconnecting one specific voltage dividing resistor to or from said other voltage dividing resistors, said connecting means including an analog switch for short-circuiting ends of said specific voltage dividing resistor in response to a control signal, said analog switch being provided in parallel with said specific voltage dividing resistor, wherein said voltage dividing resistors of said third group are connected in series, and the reference voltages are applied to ends of said third group of said voltage dividing resistors, said specific voltage dividing resistors being two voltage dividing resistors positioned at the ends of said third group; and said analog switch being provided in parallel with each of said specific voltage dividing resistors, wherein said analog switch is made of a metal oxide semiconductor-type field effect transistor.

* * * * *